US006073860A

United States Patent [19]

Coppock

[11] Patent Number: 6,073,860

[45] Date of Patent: Jun. 13, 2000

[54] ANTI-SPILLING DOWN FLOW DRINKING STRAW

[76] Inventor: Craig A. Coppock, 5911 S. Abbott Rd., Spokane, Wash. 99224

[21] Appl. No.: 09/302,417

[22] Filed: Apr. 30, 1999

[51] Int. Cl.[7] ..... A47G 21/18

[52] U.S. Cl. ..... 239/33; 239/24; 215/229; 215/388; 220/705; 220/710

[58] Field of Search ..... 239/16, 24, 33; 215/229, 388, 389; 220/705, 710; 604/54, 77, 78, 257

[56] References Cited

U.S. PATENT DOCUMENTS

| | | | |
|---|---|---|---|
| 3,517,884 | 6/1970 | Horvath . | |
| 4,196,747 | 4/1980 | Quigley et al. . | |
| 4,216,801 | 8/1980 | Aykanian | 239/33 X |
| 4,699,318 | 10/1987 | Donatello et al. . | |
| 4,736,887 | 4/1988 | Inaba | 239/33 |
| 4,848,622 | 7/1989 | Kroetsch | 604/78 X |
| 4,971,048 | 11/1990 | Seekins . | |
| 5,201,460 | 4/1993 | Caines | 239/33 X |
| 5,335,851 | 8/1994 | Adaska et al. | 239/33 |
| 5,361,987 | 11/1994 | Matheussen et al. . | |
| 5,370,279 | 12/1994 | Tardif | 215/229 X |
| 5,484,405 | 1/1996 | Edstrom, Sr. | 604/77 |
| 5,662,268 | 9/1997 | Katzenberger . | |
| 5,671,863 | 9/1997 | Uliana | 239/33 X |

*Primary Examiner*—Andres Kashnikow
*Assistant Examiner*—Steven J. Ganey
*Attorney, Agent, or Firm*—Terrance L. Siemens

[57] ABSTRACT

A down-flow drinking straw that delivers liquid below a drinking vessel while eliminating siphoning to avoid spills. The straw has a first straight supply tube portion connected by an adjustable bend to a pickup tube portion with a liquid reservoir just below the adjustable bend. The adjustable bend is biased to a normal position, such that the supply tube portion is above the reservoir when the straw is released. Once the supply tube portion is above the reservoir, the reservoir provides a volume of liquid to reverse the siphon and pull the remaining liquid in the supply tube portion back into the vessel. A first embodiment has a reservoir in the form of an increased diameter portion that extends from below the adjustable bend downwardly. At the bottom of the increased diameter portion, the pickup tube may neck down to a smaller diameter to reduce the flow rate or the pickup tube has an increased diameter along its entire length, to maximize the return flow rate. Another embodiment of the straw has a reservoir in the form of spiral sections of straw that connect the pickup tube portion to the adjustable end. When used with a beverage can type vessel (as opposed to a glass), the spiral sections have the additional function of supporting the straw on the beverage can top.

6 Claims, 3 Drawing Sheets

ANTI-SPILLING DOWN FLOW DRINKING STRAW

BACKGROUND OF THE INVENTION

1. Field of the Invention

The present invention relates generally to fluid handling. More specifically, the invention comprises a drinking straw specially designed to delivery fluid below the bottom of a drinking glass, while preventing siphoning after an individual has stopped drinking, to reduce the amount of liquid spilled. The invention is particularly useful in hospitals, convalescent homes and private homes for use by bed-ridden individuals.

2. Description of the Prior Art

When drinking from a reclined position, many times the glass or cup of fluid is above the mouth of the individual drinking. Rather than simply pouring the liquid into their mouth, a straw is oftentimes used to deliver the liquid below the bottom of the glass and into the individual's mouth. When the delivery end of the straw is below the fluid level of the glass a siphon is created, so that even after a person stops sucking on the straw, fluid continues to flow through the straw. This can be very messy as liquid can spill on the person's face and clothes. When a second person is assisting the individual in drinking (such as a nurse with a patient), the second person will usually hold the glass, and raise the delivery end of the straw to stop the liquid from flowing. This is a cumbersome two-handed process. While many prior art drinking straw improvements have been presented, the present invention is unique in that it overcomes these drawbacks by providing a down flow straw that automatically prevents siphoning.

A spiral drinking straw, particularly for use by individuals in bed, is discussed in U.S. Pat. No. 3,517,884, issued to Horvath on Aug. 5, 1968. This straw is mainly intended for entertainment purposes to thereby promote drinking in bed-ridden and ill individuals. No other function for the spirals is suggested, and anti-siphoning is not mentioned, nor is the construction of the tube capable of providing this feature.

U.S. Pat. No. 4,196,747, issued to Quigley et al. on Apr. 8, 1980, discloses a flexible drinking tube with a check valve. The tube is intended to help individuals suck liquid out of the tube without the fluid returning to the glass. The siphoning problem created once the liquid is flowing, is not addressed in this patent, nor could the valves function to alleviate the problem as does the present invention.

A drinking apparatus is detailed in U.S. Pat. No. 4,699,318, issued to Donatello et al. on Oct. 13, 1987. This apparatus enables more than one person to drink from the same container. Each of a plurality of drinking tubes includes a check valve to avoid back flow for sanitary reasons. The drinking apparatus is not designed to deliver fluid below the pitcher of liquid, and anti-siphoning is not discussed.

U.S. Pat. No. 4,971,048, issued to Seekins on Nov. 20, 1990, is drawn to a dual valve liquid transfer tube. The tube is primarily designed to assist individuals wearing gas masks to drink from a closed canteen. Two flow paths are provided with a check valve in each path for allowing flow in opposite directions through the paths. In this manner, liquid can be drawn from the canteen, while air is admitted to the canteen to avoid a negative pressure build-up. Due to the closed system, siphoning is not a concern, and is not discussed.

Another straw device is disclosed in U.S. Pat. No. 5,361,987, issued to Matheussen et al. on Nov. 8, 1994. This device includes an enlarged portion on the straw. The enlarged portion is constructed such that once liquid is sucked through the straw and into the enlarged portion, a part of the enlarged portion remains filled with the liquid. In this manner, when a colored liquid is used, the part of the enlarged portion that is filled with the colored liquid presents a certain aspect or appearance. Siphoning is not discussed, and the construction of the straw is not capable of anti-siphoning action.

U.S. Pat. No. 5,662,268, issued to Katzenberger on Sep. 2, 1997, discloses a therapeutic drinking straw machine. This machine is specially designed to assist individuals with swallowing problems, and includes a pump that delivers a repeatable volume to the individual. While the pump and straw construction will avoid siphoning, such an assembly is cost prohibitive, difficult to use (requiring at least two hands) and is not necessary for individuals that may be bed ridden, but are capable of ordinary drinking.

None of the above inventions and patents, taken either singly or in combination, is seen to describe the instant invention as claimed.

SUMMARY OF THE INVENTION

The present invention is a down-flow drinking straw that delivers liquid below a drinking vessel while eliminating siphoning to avoid spills. This is accomplished by providing a straw having a first straight supply tube portion connected by an adjustable bend to a second straight pickup tube portion with an increased diameter portion below the adjustable bend. The adjustable bend is biased to a normal position, such that the supply tube portion is above the increased diameter portion when the straw is released. Once the supply tube portion is above the increased diameter portion, the increased diameter portion provides a volume of liquid to reverse the siphon and pull the remaining liquid in the supply tube portion back into the glass. The volume of liquid in the enlarged diameter portion of the straw (above the water level) exceeds the volume of the entire supply tube portion.

The present invention includes several different embodiments of the anti-spilling down flow drinking straw. The first embodiment has a first long straight supply tube portion connected by an adjustable bend to a second straight pickup tube portion with an increased diameter portion that extends from below the adjustable bend downwardly. At the bottom of the increased diameter portion, the pickup tube necks down to a smaller diameter to reduce the flow path and the speed at which the liquid returns to the glass when the straw is released and the siphon is reversed. In a further embodiment, the pickup tube has an increased diameter along its entire length, to maximize the return flow rate.

Another embodiment of the straw has a first long straight supply tube portion connected by an adjustable bend to a second straight pickup tube portion with an increased diameter portion that extends from below the adjustable bend downwardly. In this embodiment however, spiral sections of straw connect the increased diameter portion to the adjustable end. The spiral sections are most useful when a container having a cover with a small opening is used (such as an aluminum can). The straw is rotated and the lower spiral sections of the straw are routed through the opening and below the cover. This results in the spiral sections of the straw gripping the cover from below and above thus supporting the straw on the container. By supporting the straw's pickup tube portion, the spring action of the adjustable bend is better able to lift the supply tube portion to the correct height for draining the straw. The spring action itself can be provided by the spiral sections. The increased diameter portion in this embodiment extends to the bottom of the pickup tube.

Accordingly, it is a principal object of the invention to provide a down flow drinking straw that reduces spilling after a person has finished drinking.

It is another object of the invention to allow a person to use a down flow straw in a hands free manner while still avoiding spilling when the person has finished drinking.

It is a further object of the invention to provide an enlarged portion in an anti-spilling, down flow straw to increase the return flow rate.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
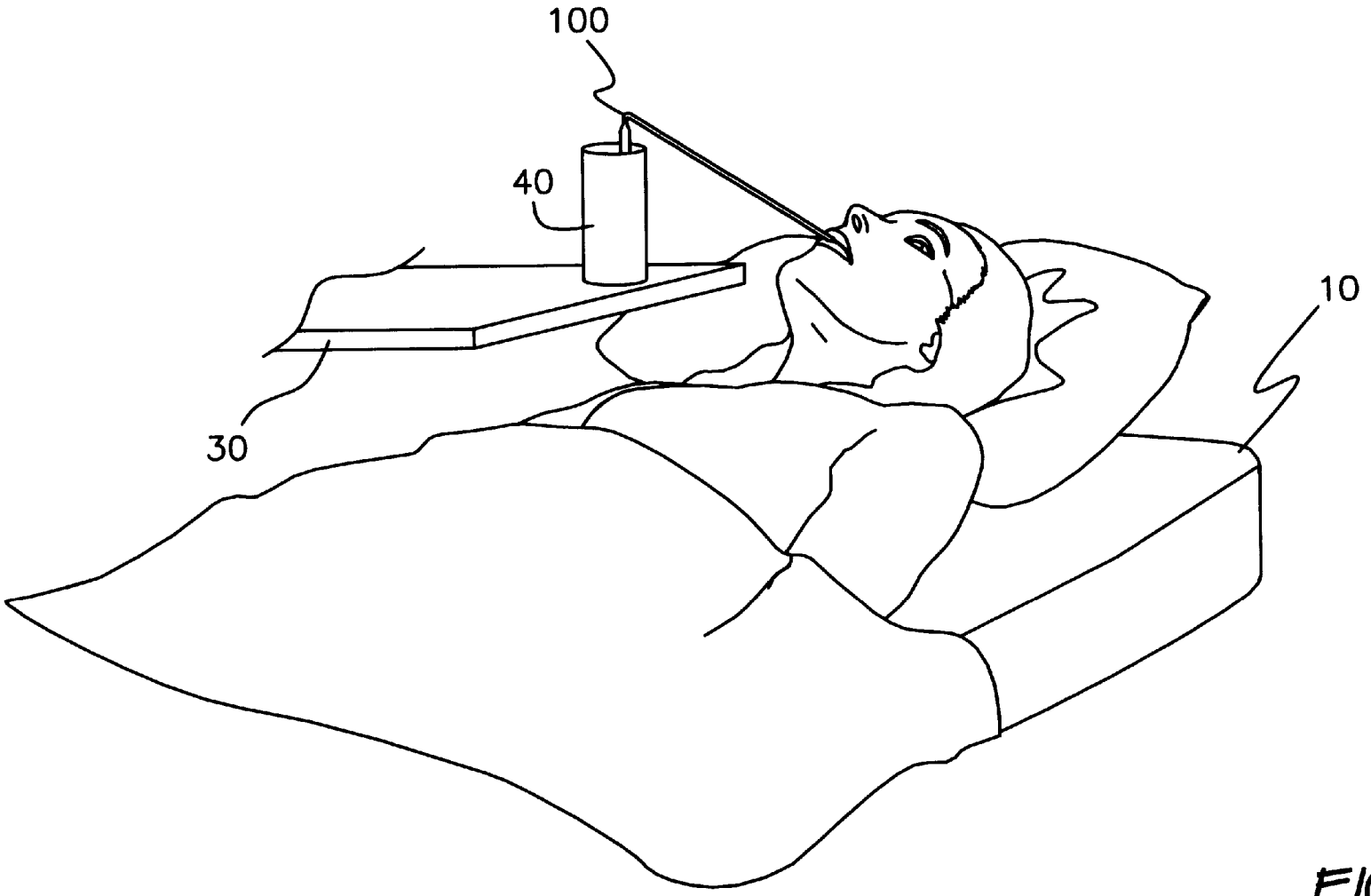
FIG. 1 is an environmental view of a bed-ridden person using the anti-spilling down flow drinking straw of the present invention to drink liquid from a glass, in a hands free manner.

In FIG. 1, a person is shown drinking liquid in bed 10 from a glass 40 using the anti-spilling down flow straw 100 of the present invention. The glass 40 is shown sitting on a table 30, however the glass 40 could be held by a medical professional or by the user themselves, should they be able. The elevational height of the table 30 is above the person's mouth such that the down flow straw 100 is needed to drink from the glass 40. To use the straw 100, a pickup end is placed in the glass, and a supply end is lowered until grasped by the lips by the user. This can be done by the person using the straw if they are able, or by a medical professional if the person does not have use of their hands. When they are finished drinking, the user releases the supply end of the straw 100 from their lips, and the supply end is biased upwards to reduce or even eliminate spilling due to siphoning of the liquid.

Figure 2:
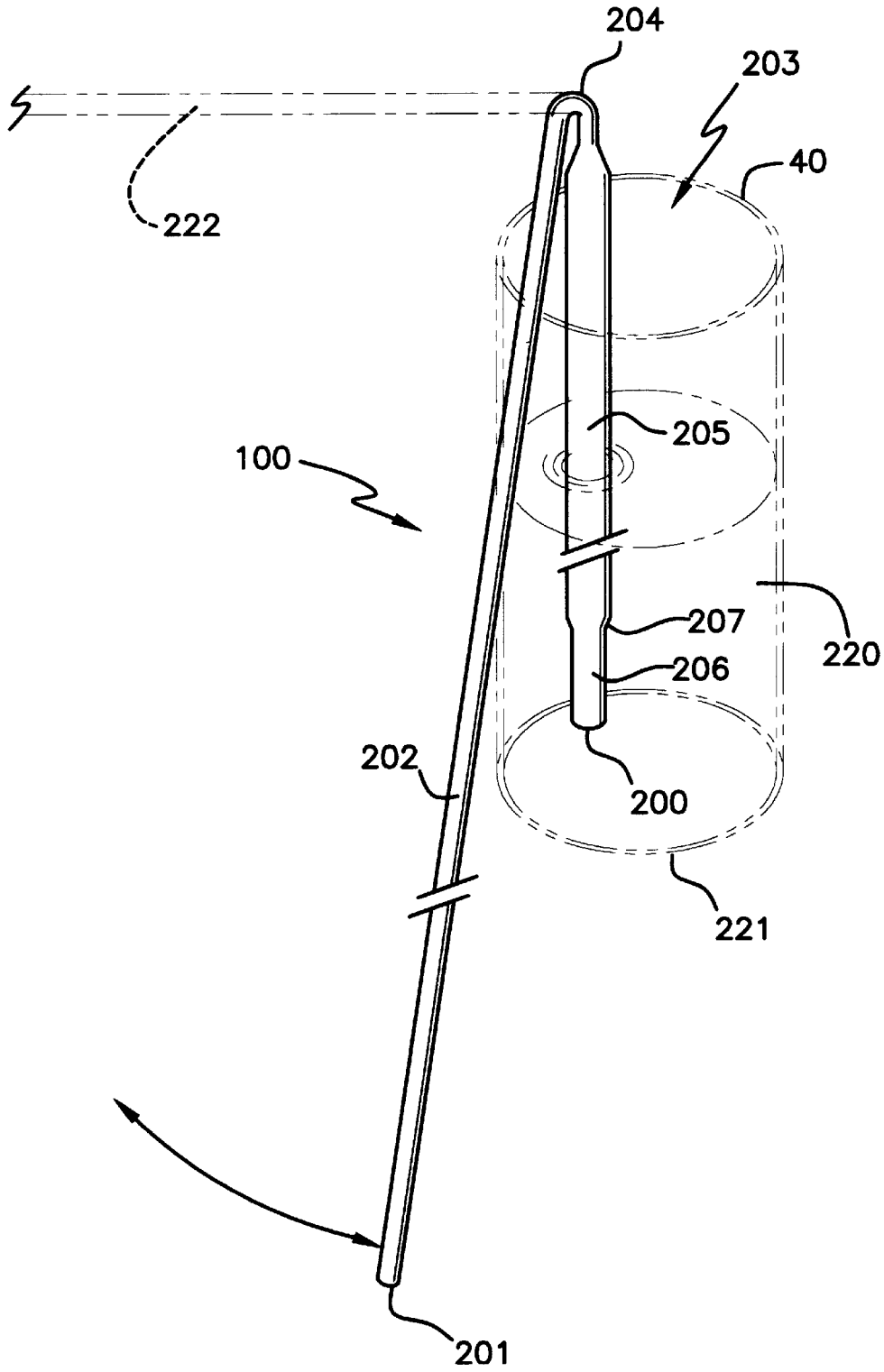
FIG. 2 is a side view of a glass containing a first embodiment of the anti-spilling down flow drinking straw, having a straight pickup tube.

The details of the embodiment of the down flow straw 100 of FIG. 1 are more clearly shown in FIG. 2. A first pickup end 200 of the down flow straw 100 is placed in glass 40 which contains a consumable liquid 220 such as water, soda, milk etc. The second supply end 201 of the straw 100 extends below the bottom 221 of glass 40, to deliver liquid 220 below the glass. The supply tube portion 202 is formed as a long, straight, relatively narrow tube, and is attached to the pickup tube portion 203 by an adjustable bend 204. Adjustable bend 204 is spring biased to normally maintain supply tube portion 202 in the position shown by the dotted lines at 222. The pickup tube portion 203 includes a reservoir in the form of an increased diameter portion 205 that provides a volume of liquid greater than the total volume of the supply tube portion 202. At the bottom 207 of the increased diameter portion 205, pickup tube 203 necks down to reduced diameter portion 206, for reasons explained hereinafter.

In use, the second supply end 201 of the straw 100 is placed in the user's mouth (which is below the bottom 221 of the glass 40), and grasped using their lips. When the user is finished drinking, they release the second supply end 201 of the straw 100, and the adjustable and biased bend 204 raises the supply tube 202 to the normal position 222. At this point the volume of liquid in the reservoir or increased diameter portion 205 is lower than the supply tube 202. This causes a reverse siphoning action that returns substantially all of the liquid in the straw 100 to the glass 40 (except that liquid which is below the level of liquid in the glass 40). The reduced diameter portion 206, at the bottom 207 of the increased diameter portion 205, reduces the liquid return flow rate by decreasing the cross sectional flow area. Preferably, the increased diameter portion 205 extends to the pickup end 200 at the bottom of the pickup tube 203 (as described in the second embodiment below), to thereby maximize the liquid return flow rate and volume.

Figure 3:
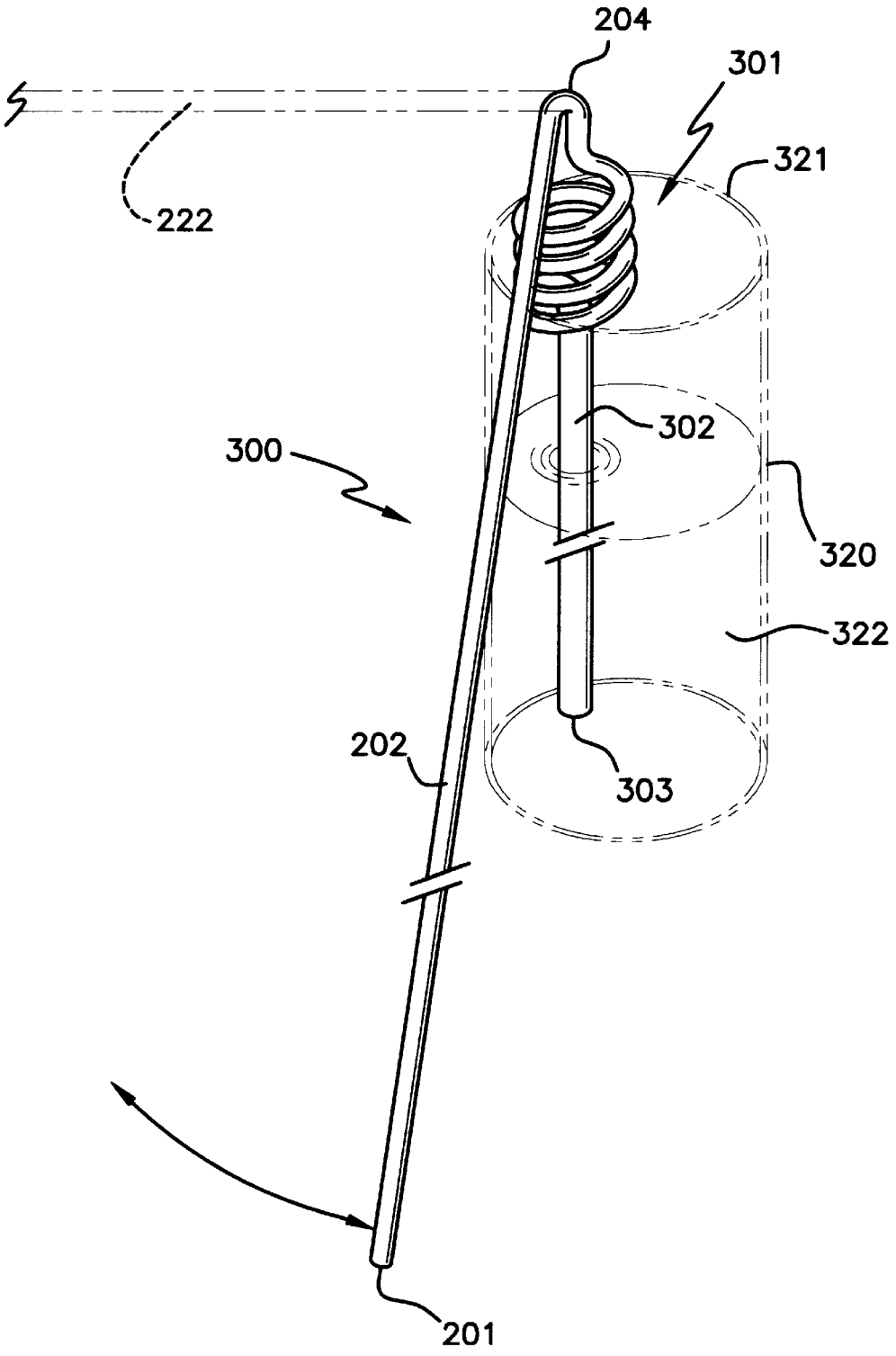
FIG. 3 is a side view of a glass containing a second embodiment of the anti-spilling down flow drinking straw, having a spiraling pickup tube.

In a further embodiment of the anti-spilling down flow straw 300 the reservoir is in the form of a plurality of spirals 301 as shown in FIG. 3. In addition to acting as a reservoir, the spirals 301 anchor the straw 300 when it is installed in a soda can type container 320. Container 320 is a can of the type that has a small opening on the top surface close to the circular upper edge 321 of the can 320. The pickup end 303 of the down flow straw 300 is placed in the can 320 which contains a consumable liquid 322 such as canned water, soda, beer, etc, until the bottom of spiral section 301 contacts the top of the can 320. The straw 300 is then rotated such that at least one spiral is below the top of the can and at least one spiral is above the top of the can. In this manner the top of the can is grasped by the spirals (due to the resilient nature of the material of the straw), to thereby support the straw on the can. In addition to the spirally shaped reservoir 301, the pickup tube portion 302 has an increased diameter from the spiral section 301 to the pickup end 303. This increases both the liquid return flow rate and volume, as described above. The pickup tube 302 could alternatively neck down to reduced diameter portion at the pickup end 303, as in the first embodiment. The supply tube 202 and adjustable bend 204 operate in substantially the same manner as the first embodiment described above. The spring action of the adjustable bend, however, may be provided or enhanced by the spiral shape of the top of the pickup tube. Once the bottom spiral or spirals have been routed through the opening in the top of the can, those spirals above the top of the can provide a spring function by their shape as well as the resilient nature of the material of the straw.

The actual material used to make the straw may be any of a number of available plastics, acrylics, polyurethanes, etc., as long as the material provides the spring function of the adjustable bend. Various colors and reservoir shapes may also be envisioned for aesthetic and entertainment purposes.

It is to be understood that the present invention is not limited to the embodiments described above, but encompasses any and all embodiments within the scope of the following claims.

I claim:

1. An anti-spilling down flow drinking straw for delivering liquid to a user's mouth which is below a bottom of a drinking vessel containing the liquid, said anti-spilling down flow drinking straw comprising:

a supply tube portion with an internal volume, said supply tube portion having a supply end for placing in the user's mouth and a second end;

a pickup tube portion having, a first pickup end for placing near the bottom of and within the vessel, a reservoir with an internal volume greater than said internal volume of said supply tube portion, and a second end extending out of the vessel; and an adjustable bend connecting said second end of said pickup tube portion to said second end of said supply tube portion, said adjustable bend including a spring function; wherein said spring function maintains said supply tube portion in a first normal position wherein said supply tube portion is above said reservoir;

said supply tube can be lowered against said spring function to place said supply end in the user's mouth; and when the user has finished drinking and releases said supply end from their mouth, said spring function returns said supply tube to said normal position; and liquid in said reservoir returns to the vessel thereby creating a siphon to return liquid in the supply tube portion to the vessel.

2. The down flow drinking straw according to claim 1, wherein said reservoir comprises an enlarged diameter portion of said pickup tube portion extending just below said adjustable bend.

3. The down flow drinking straw according to claim 2, wherein said enlarged diameter portion of said pickup tube portion extends from just below said adjustable bend to said first pickup end.

4. The down flow drinking straw according to claim 2, wherein a bottom of said enlarged diameter portion necks down to a reduced diameter portion, said reduced diameter portion extending from said enlarged diameter portion to said first pickup end.

5. The down flow drinking straw according to claim 1, wherein the vessel is a beverage type can with a cover having a small opening and wherein:

said reservoir comprises a plurality of spirals of said pickup tube portion extending just below said adjustable bend; and bottommost spirals of said plurality of spirals are routed through the small opening thereby gripping the cover between adjacent spirals to support said straw on the can.

6. The down flow drinking straw according to claim 5, wherein topmost spirals of said plurality of spirals provide the spring function.

* * * * *